US005618375A

United States Patent [19]

Suzuki et al.

[11] Patent Number: 5,618,375

[45] Date of Patent: Apr. 8, 1997

[54] ENVELOPE PROCESSING UNIT

[75] Inventors: Norio Suzuki; Atsushi Satake; Kohki Sato, all of Tokyo, Japan

[73] Assignee: Juki Corporation, Tokyo, Japan

[21] Appl. No.: 432,194

[22] PCT Filed: Nov. 11, 1992

[86] PCT No.: PCT/JP92/01468

§ 371 Date: May 4, 1995

§ 102(e) Date: May 4, 1995

[87] PCT Pub. No.: WO94/11206

PCT Pub. Date: May 26, 1994

[51] Int. Cl.[6] ..... B43M 5/04

[52] U.S. Cl. ..... 156/442.3; 53/284.3; 53/381.5; 53/381.6; 53/381.7; 53/569; 156/442.2

[58] Field of Search ..... 156/442.2, 442.3; 53/569, 284.3, 381.5, 381.6, 381.7

[56] References Cited

U.S. PATENT DOCUMENTS 5,072,922 12/1991 Paulson ..... 271/99

FOREIGN PATENT DOCUMENTS 2913428 10/1980 Germany .
2090807 7/1982 United Kingdom ..... 53/284.3

*Primary Examiner*—Jeff H. Aftergut
*Attorney, Agent, or Firm*—McCormick, Paulding & Huber

[57] ABSTRACT

A mail enclosing and sealing apparatus (50) in which an envelope (1, 200) is pulled out from an envelope guide (54) in an envelope hopper (52) which stacks the envelopes one by one, the envelope being fed to a gripper means (60) displaced on an envelope transferring belt (58) being driven intermittently, and transferred under the movement of the belt (58) while being held by the gripper means (60), with a flap portion being opened at a given position (S2), and is then transferred to a further position (S3), with the envelope (1, 200) being opened by an opening means (62), and an enclosure (66) transferred from an other route (64) being enclosed in the envelope, then the envelope (1, 200) with the enclosure (66) is transferred to a further position (S4), then said envelope (1, 200) being displaced in a direction crossing the flow of the belt (58) and route (64) to be sealed; wherein the position adjustment of the opening means (62) and the adjustment of the side guide widthwise direction control axis (90) for the enclosures are synchronizingly adjusted, and the position of the envelope hopper portion (52) is freely movable and adjustable in the widthwise direction of the device (50), and the center line n—n of the opening of the envelope (1, 200) is adjusted to correspond to the center line (L—L) of the device (50).

7 Claims, 6 Drawing Sheets

ENVELOPE PROCESSING UNIT

TECHNICAL FIELD

This invention relates to a mail enclosing and sealing apparatus and, more particularly, to a mail enclosing and sealing apparatus having an envelope processing function for enabling an envelope being utilized to act at the most suitable mail enclosing condition.

BACKGROUND ART

According to a prior art mail enclosing and sealing apparatus which has been invented by the applicant of the present invention, as shown in FIG. 1, envelopes 1 are taken out one by one from envelope guides 3 of an envelope hopper 2 receiving therein a multiple number of envelopes 1. The envelopes 1 being taken out are supplied, through a series of rollers 4, to a gripper 6 which is mounted on an envelope transporting chain 5 being driven intermittently and waiting at an envelope receiving position A. Then, the gripper 6 moves, in accordance with the movement of the chain 5, the envelope 1 to an envelope opening position B. At the position B, the flap portion of the envelope 1 is opened in the arrow 7 direction by flap opening means known per se. Thereafter, the envelope 1 is transported to an enclosure inserting position C with the flap portion being maintained at the open condition. The opening portion of the envelope 1 is opened widely by opening means 8 such as a vacuum pad and the like, and an enclosure 10 being transported through another route 9 is enclosed in the envelope 1. Then, the envelope 1 enclosing therein the enclosure 10 is transported to an ejecting position D and is ejected in a direction perpendicular to the moving direction of the chain 5 and the route 9 (the direction perpendicular to the paper of the drawing), and the envelope 1 is sealed.

The envelope guides 3, 3 are mounted, as shown in FIG. 2, on blocks 11, 11. The blocks 11, 11 are threadingly engaged respectively with a shaft 12 having left and right hand screw-threads. A knob 13 is mounted on one end of the shaft 12. Thus, by rotatingly adjusting the knob 13, the envelope guides 3, 3 move in the directions of the arrows perpendicular to the longitudinal center line L—L of the apparatus and by the same amount. It will be understood that almost all prior art envelopes have a symmetrical configuration in the left and right as shown in FIG. 2. And the center line of the opening of the envelope 1 coincides with the center line of the envelope 1, and is located on the longitudinal center line L—L of the machine. Thus, various sizes of envelopes 1 can be handled by the machine by locating the envelope guides 3 adjustable symmetrically in the left and right directions with respect to the longitudinal center line L—L of the machine.

However, in one type of recent envelope, particularly for use in direct mails, for easily been opened by the person who received the direct mail, there is provided, as shown in FIG. 3, a flap portion 14 along one side edge of the envelope and perforations defining a cutting line 15 for opening the envelope near to one of the side edges. In such case, an envelope 200 can easily be opened without utilizing a knife and the like by tearing one side of the envelope along the perforations 15. In the envelope 200, the widthwise centerline m—m of the envelope does not coincide with the center-line n—n of the enclosure being provided in the envelope. Thus, when the envelope 200 is utilized in the machine shown in FIG. 2, the center line of the enclosure 10 is located on the center line L—L of the machine, and when the enclosure 10 is moved into the envelope 200, one side of the enclosure 10 overlaps with the flap portion 14 of the envelope by an amount 16, and the one side of the enclosure may abut with the flap portion which may prevent smooth insertion of the enclosure 10 into the envelope 200.

Further, in usual mail enclosing and sealing apparatus, the dimension of the opening of the envelope is determined to be sufficiently larger than the width of the enclosure being inserted into the envelope through the opening, and the opening device such as vacuum pads 8 are located near to opposite side edges of the envelope, however, when a flap portion is provided adjacent to one side edge of the envelope, the function of the vacuum pad is impeded and the envelope will not open sufficiently.

As shown in FIG. 4, the opening device such as vacuum pads 8 are mounted respectively on one ends of levers 20. The position of the opening device 8 can be adjusted by rotating a width adjusting shaft 21 having left and right hand screw-threads thereon, and through guide plates 23 engaging with the screw threads of the shaft 21 and being movable along a drive shaft 22, support members 24 mounted on the guide plates 23, blocks **24*a* slidable along the support members 24, L-shaped arms 25 with one ends being connected to the blocks 24*a* and the other ends being secured to levers 20. In the drawing, the drive shaft 22 is moved pivotally by drive means not shown in the drawing to afford up and down movement of the opening device 8 through a pair of arms 26 and a shaft 27 with opposite ends of which being secured to the arms 26 and acting on the blocks 24. Further, there are provided insert guides 28 displaceable along a shaft 29. For adjusting the positions of the insert guides 28, there is provided an insert guides adjusting shaft 30 having thereon left and right hand screw threads. The screw threads of the shaft 30 engage respectively with one ends of a pair of guide plates 31, and the other ends of the guide plates 31 are connected to a rotatable shaft 32 displaceably only in the directions of the axis of the shaft 32. The shaft 32 is rotated by rotating means not shown in the drawing. The guide plates 31 and the insert guides 28 are connected through connecting bars 33. By rotatingly adjusting the insert guides adjusting shaft 30, widthwise positions of the insert guides 28 are adjusted along the shaft 29 through the guide plates 31 movable along the shaft 32 and the connecting bars 33. Further, by adjusting the shaft 32, it is possible to adjust the inclination and the amount of displacement of the insert guides 28. Thus, when the size of the envelope is given, it is required to adjust the positions of the opening device 8 and the insert guides 28 independently by adjusting knobs 34 and 35 being secured to the shafts 21 and 30**.

Further, as shown in FIG. 5, the device for transporting the enclosure 10 includes side guides 36 for guiding opposite sides of the enclosure 10. The side guides 36 are mounted on an adjusting shaft 38 having left and right hand screw-threads thereon. By adjusting the shaft 38 through an adjusting knob 40, the space between the side guides 38 is adjusted.

Thus, in the prior art machine, it is required to adjust independently the width of the envelope guide 3, the width of the opening means 8, the width of the insert guides 28 and the width of the side guides 36. Such an adjusting operation is troublesome and time consuming.

Further, when the envelope is of a particular configuration such as the envelope 200 having cutting perforations, it is required to further adjust the position of the side guides and the opening means 8. That is, when the opening means 8 such as that comprising vacuum pads in the prior art machine is located near to the opposite side edges of the envelope, the outer opening means 8 are positioned as far as possible at the side edge positions (as shown in FIG. 6) so that the opening means 8 at one end is positioned on the gluing flap portion 14. Consequently, said opening means 8 at one end can not act as a suitable opening means, and also, the opening means neighboring said opening means at one end can not be positioned at the outmost position of the envelope opening, and it can not effect proper opening of the envelope.

DISCLOSURE OF INVENTION

This invention discloses a device which is able to adjust the position of an envelope promptly so as to enclose the enclosures securely into the envelope which is a peculiar one such as the envelope with perforations having the center line m—m of the envelope which does not coincide with the center line n—n of the envelope opening. Further, in this invention, the position of the hopper can be adjusted freely in the width direction of the mail enclosing and sealing apparatus, and the position of opening means can be adjusted with the width of the side guide means cooperately.

BEST MODE FOR CARRYING OUT THE INVENTION

Figure 7:
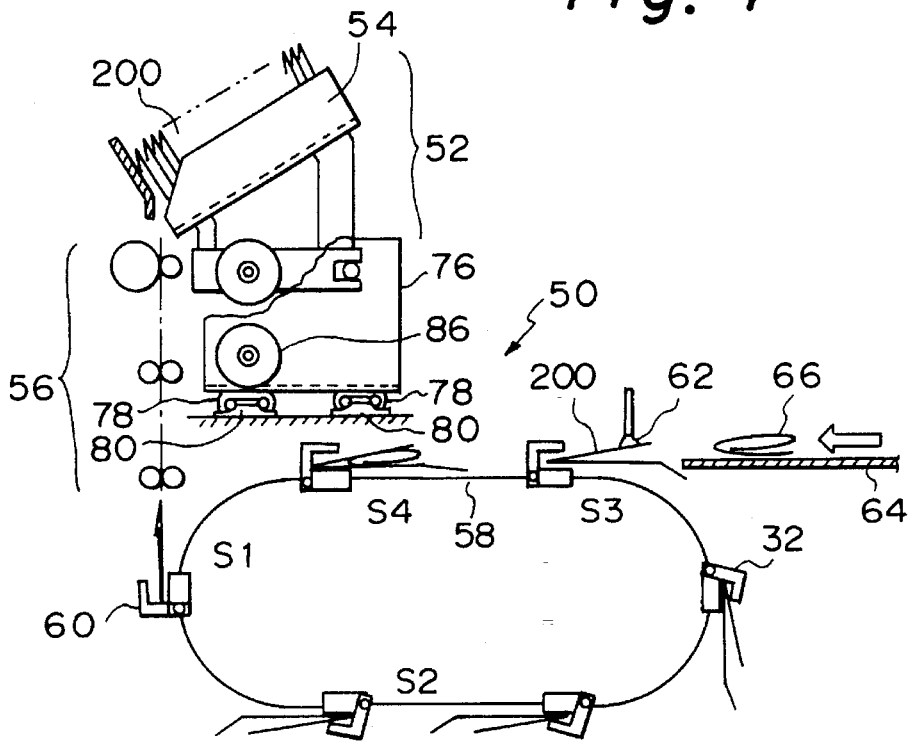
FIG. 7 is a schematic side view showing operation steps in a mail enclosing and sealing apparatus according to a preferred embodiment of the present invention.

FIG. 7 shows a mail inserting and sealing device 50 according to a preferred embodiment of the invention. In the drawing, a plurality of envelopes 200 having a cutting perforation are received in an envelope guide 54 of an envelope hopper 52 which are similar to prior art devices. The envelopes 200 are taken out of the envelope guide 54 one by one by means of a device known per se. The envelope 200 is supplied through a series of rollers 56 to one of grippers 60 which is mounted on envelope transporting chains 58 being driven intermittently and is waiting at envelope receiving position S1. The gripper 60 moves the envelope 200 to a flap opening position S2 accompanied by the movement of the chain 58. At the position S2, the flap portion of the envelope 200 is opened. Thereafter, the envelope 200 with the flap portion being open is transported to the position S3, at which, the opening portion of the envelope 200 is opened by opening means 62 comprising vacuum pads and the like. The enclosure 66 transported through another route 64 is inserted into the envelope 200. The envelope having therein the enclosure 66 is transported to position S4, and is ejected in a direction perpendicular to the direction of the movement of the chain 58 and of the route 64 (the direction perpendicular to the paper of the drawing), at that position the envelope 200 is sealed.

Figure 8:
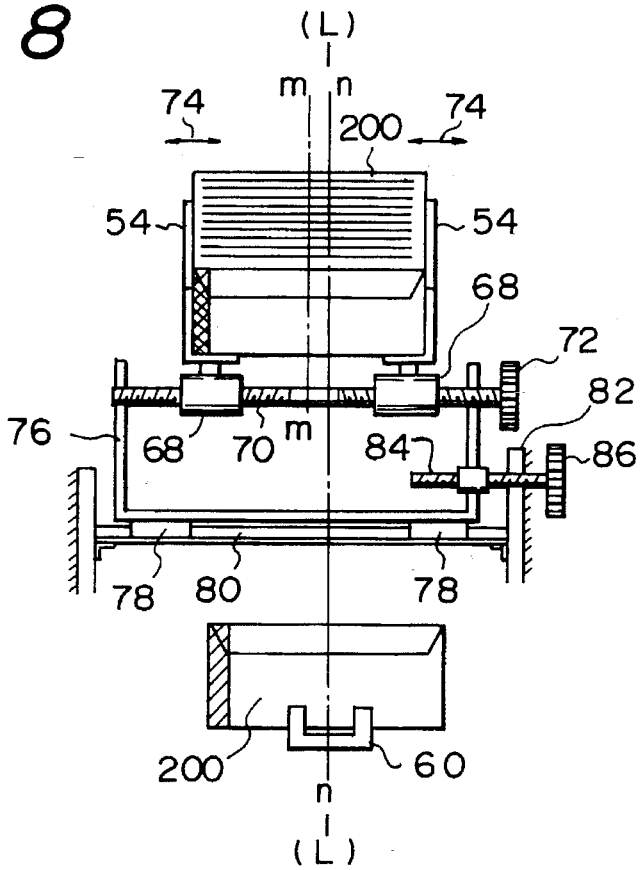
FIG. 8 is a front view of an envelope hopper portion of the mail enclosing and sealing apparatus in this invention.

As shown in FIG. 8, the envelope guides 54 are mounted on blocks 68 and 68 respectively, and the blocks engage screw-threadingly with respective screw-thread portions of a shaft 70 having left and right hand screw-threads of the same leading amount. A knob 72 is mounted on one end of the shaft 70. Thus, by rotatingly adjusting the knob 72, the envelope guides 54 move symmetrically with respect to the longitudinal center line L—L of the device 50 and in the arrow directions 74 by the same amount in the left and right directions.

Further, according to the invention, the blocks 68 and 68 supporting the envelope guides 54 are supported on a generally U-shaped offset base 76 so that the blocks 68 and 68, together with the shaft 70 and the knob 72 for adjusting the position of the blocks can be adjusted in the widthwise direction of the device 50. There are provided on the lower surface of the offset base 76 sliders 78 consisting of such a pair of roller sliders arrange in two rows. The sliders 78 are mounted, through ball bearings and the like, slidably on rails 80 mounted on a fixed frame of the device 50. The rails 80 are mounted on a frame 82. A screw shaft 84 engages screw-threadingly with the frame 82, and a knob 86 is mounted on one end of the screw shaft 84. Thus, when the knob 86 is adjusted, the envelope hopper portion 52 can move on the rails 80 as a whole.

Figure 1:
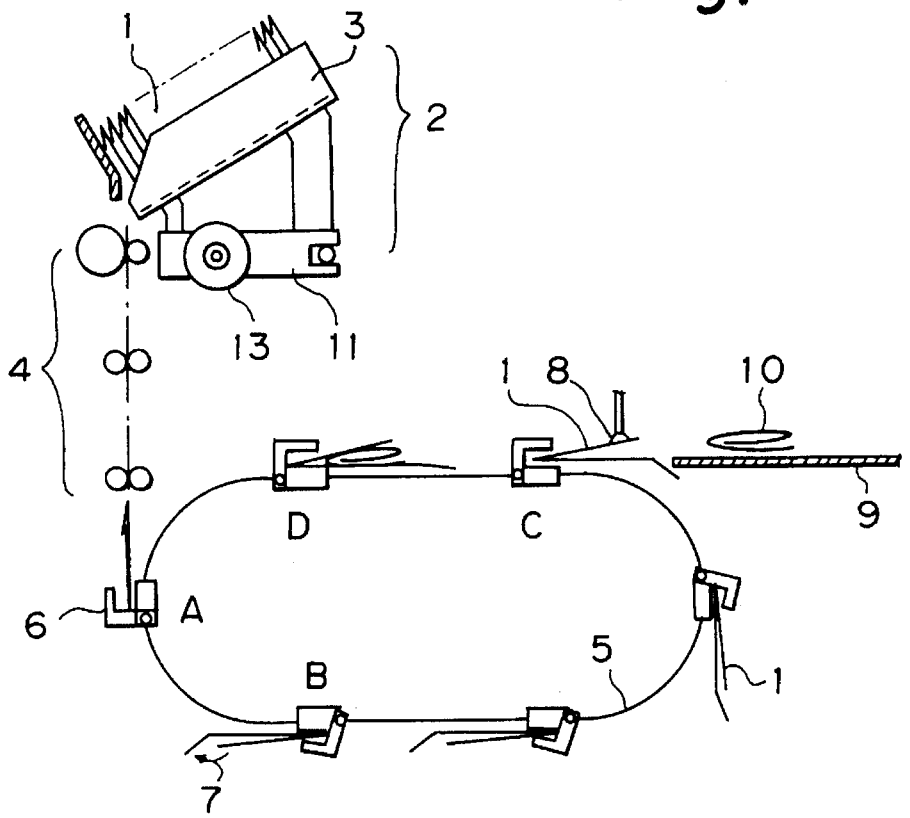
FIG. 1 is a schematic side view of showing operation steps in a prior art mail enclosing and sealing apparatus.
Figure 2:
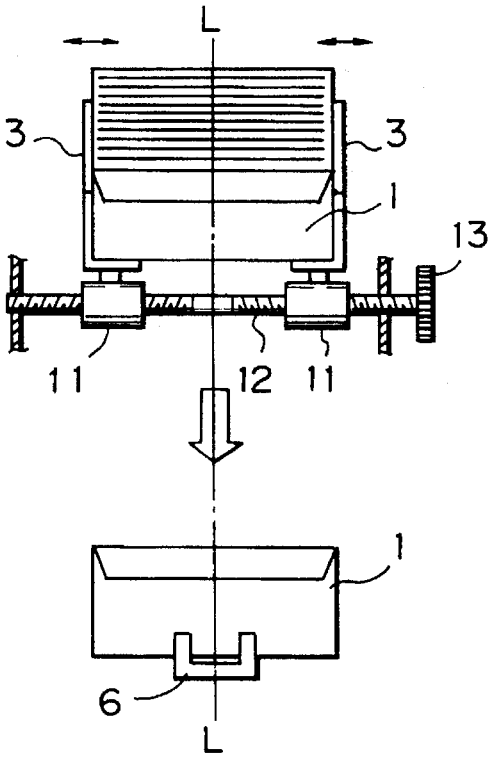
FIG. 2 is a front view of an envelope hopper portion of the prior art mail enclosing and sealing apparatus.

When the envelopes 1 having a configuration symmetrical in the left and right directions as shown in FIG. 2 are handled in the device 50 of the present invention, the knob 86 is adjusted such that the center line m—m of the envelope 1 aligns with the center line n—n of the opening of the envelope 1 for receiving the enclosure. Thus, the center line of the envelope, the center line of the opening of the envelope and the center line of the device 50 are located on a common line. In such a case, it is possible to receive and handle envelopes of various sizes by adjusting the knob 72 to move the envelope guides 54 in left and right directions by the same amount.

Figure 3:
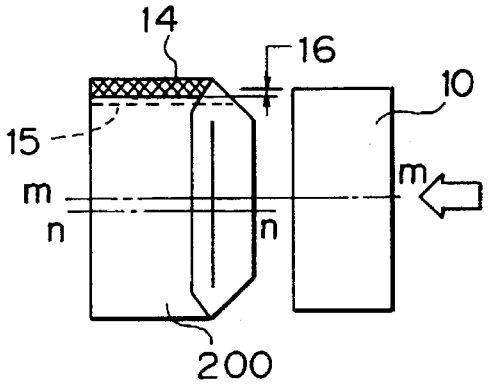
FIG. 3 is a schematic view of an envelope having opening perforations and an enclosure.

When the envelopes 200 having the configuration not symmetrical in left and right directions as shown in FIGS. 3 and 8 are utilized in the device 50 of the present invention, the center line m—m of the envelope 200 or the center line L—L of the device 50 does not align with the center line n—n of the opening of the envelope as shown in FIGS. 2 and 3. However, the mounting position of the grippers 60 for conveying the envelopes 200 and the center line of a flap opening device (not shown in the drawing) are determined to align with the longitudinal center line L—L of the device 50 according to the invention. Thus, to effectively utilize respective following units, it is required or advisable to adjust the center line n—n of the opening of the envelope 200 with the center line L—L of the device 50. At first, the knob 72 is adjusted to receive a predetermined amount of the envelope 200 having cutting perforations 15 in the envelope guide 54. Then, the knob 86 is adjusted to displace the envelope guide 54 so that the center line n—n of the opening of the envelopes 200 aligns with the center line L—L of the device 50. Thereafter, the device 50 is operated. The envelopes 200 are supplied one by one to the gripper 60 with the center line n—n of the opening of the envelopes 200 aligning with the center line L—L of the device 50, thus, the flap opening operation and the enclosure enclosing operation and the like can be performed similarly to the prior art device. Thus, according to the invention, it is possible to overcome above described discrepancies by aligning the center line n—n of the opening of the envelopes 200 with the center line L—L of the device 50.

Figure 11:
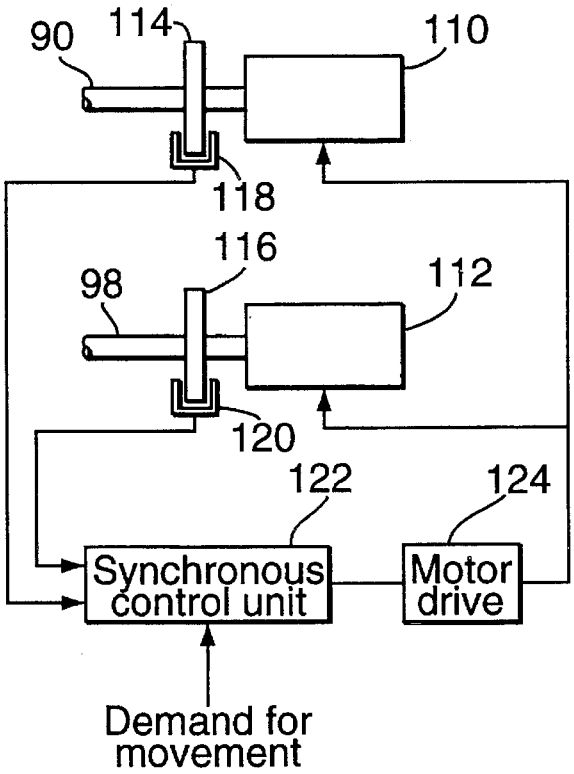
FIG. 11 is a schematic view showing another embodiment of the present invention.
Figure 12:
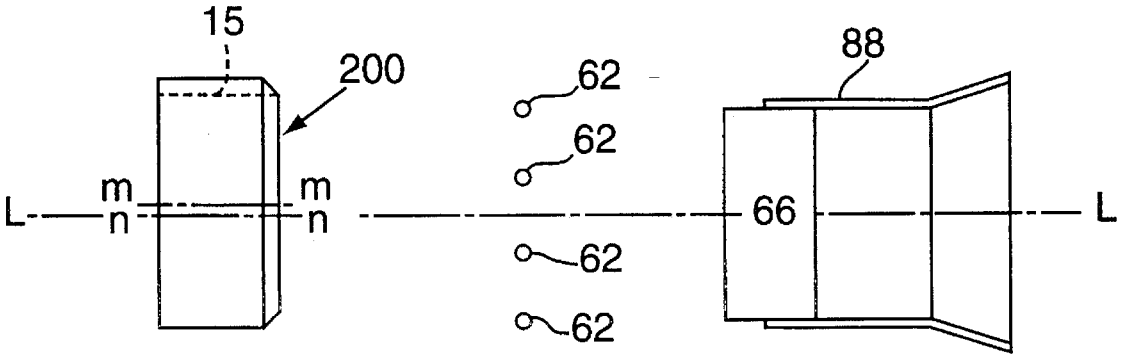
FIG. 12 is a view showing the relation between the envelope opening means and enclosure side guides according to the embodiment of FIG. 11.

FIG. 11 shows another embodiment of the present invention. In the embodiment, there are provided on respective one ends of the shafts 90 and 98 drive motors 110 and 112 such as stepping motors and the like and detecting means consisting of encoder plates 114 and 116 and detectors 118 and 120, and the motors 110 and 112 are controlled by a motor drive circuit 124 which is controlled by a synchronous control circuit 122 receiving and comparing the output pulse of the detectors 118 and 120. The synchronous control circuit 122 receives the width information of the enclosure from the keyboard or the computer, and controls the revolution of the shafts 90 and 98 through the motor drive circuit 124 and the motors 110 and 112 so as to locate the side guides 88 and the opening means 62 at corresponding positions as shown FIG. 12. It is possible to provide a drive motor and detecting means on the screw-thread shaft 84 to displace the offset base 76 so that the position of the envelope is displaced by a predetermined amount in accordance with the offset information received from the keyboard or the computer.

Further, in the embodiment, the opening means, the side guides, and the offset base are displaced by screw shafts, however, similar effects may be attained by other means such that the opening means, the side guides, and the offset base are secured to a belt, with the belt being rotated by suitable means.

Figure 4:
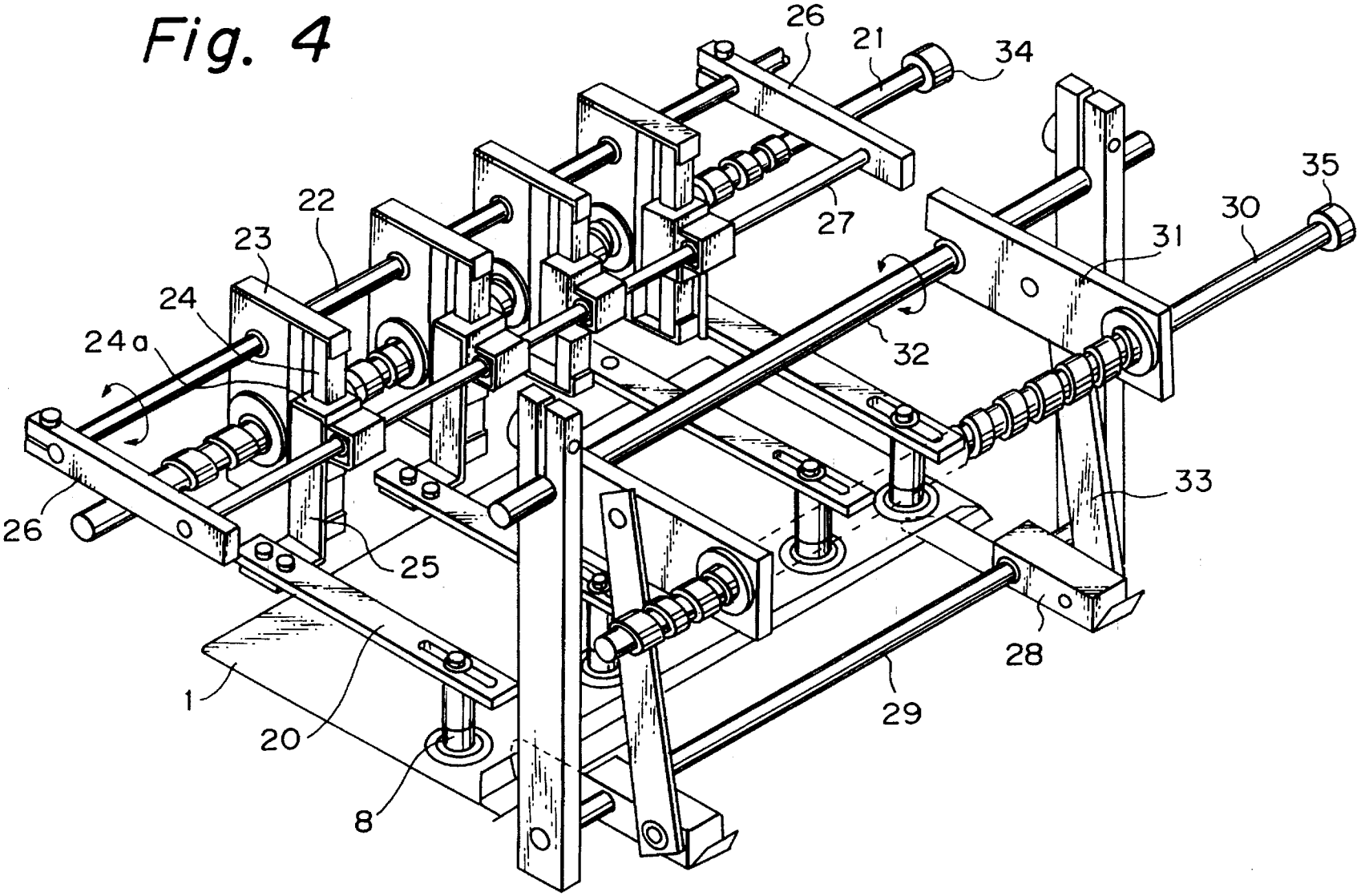
FIG. 4 is a view showing a mounting mechanism of a prior art envelope opening means.
Figure 5:
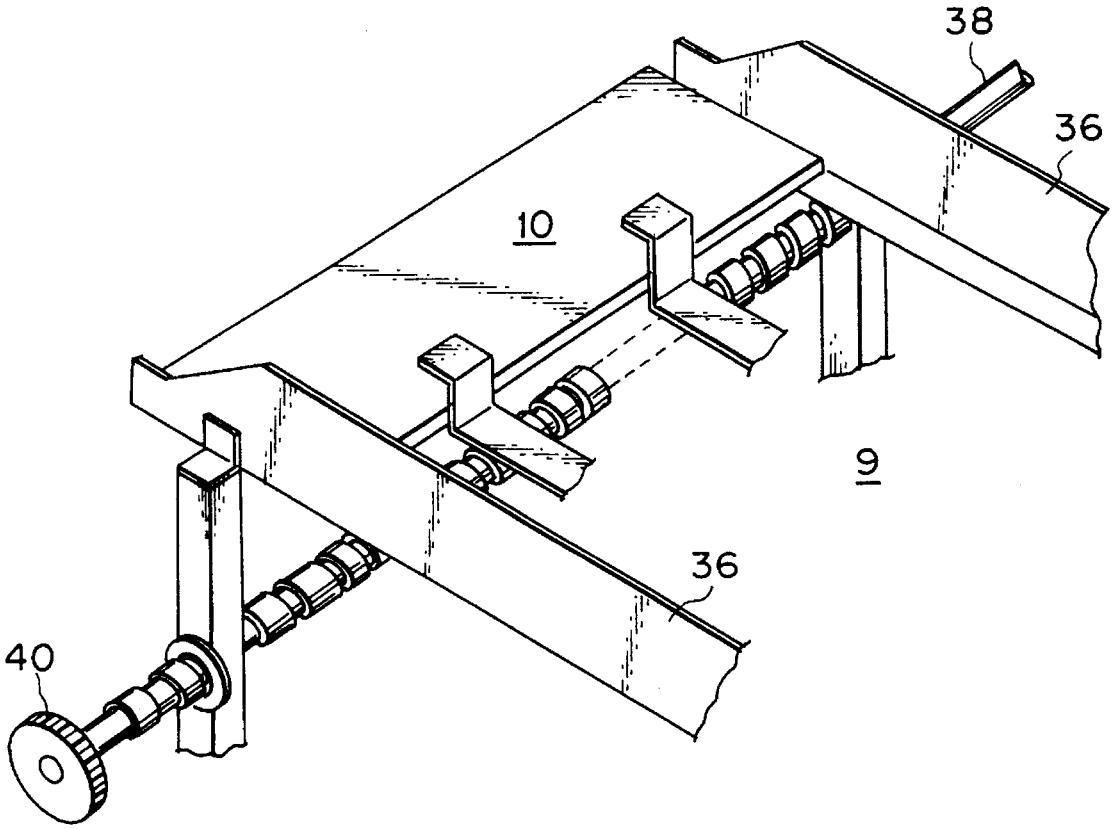
FIG. 5 is a view showing a prior art enclosure feeding mechanism.
Figures 9, 10:
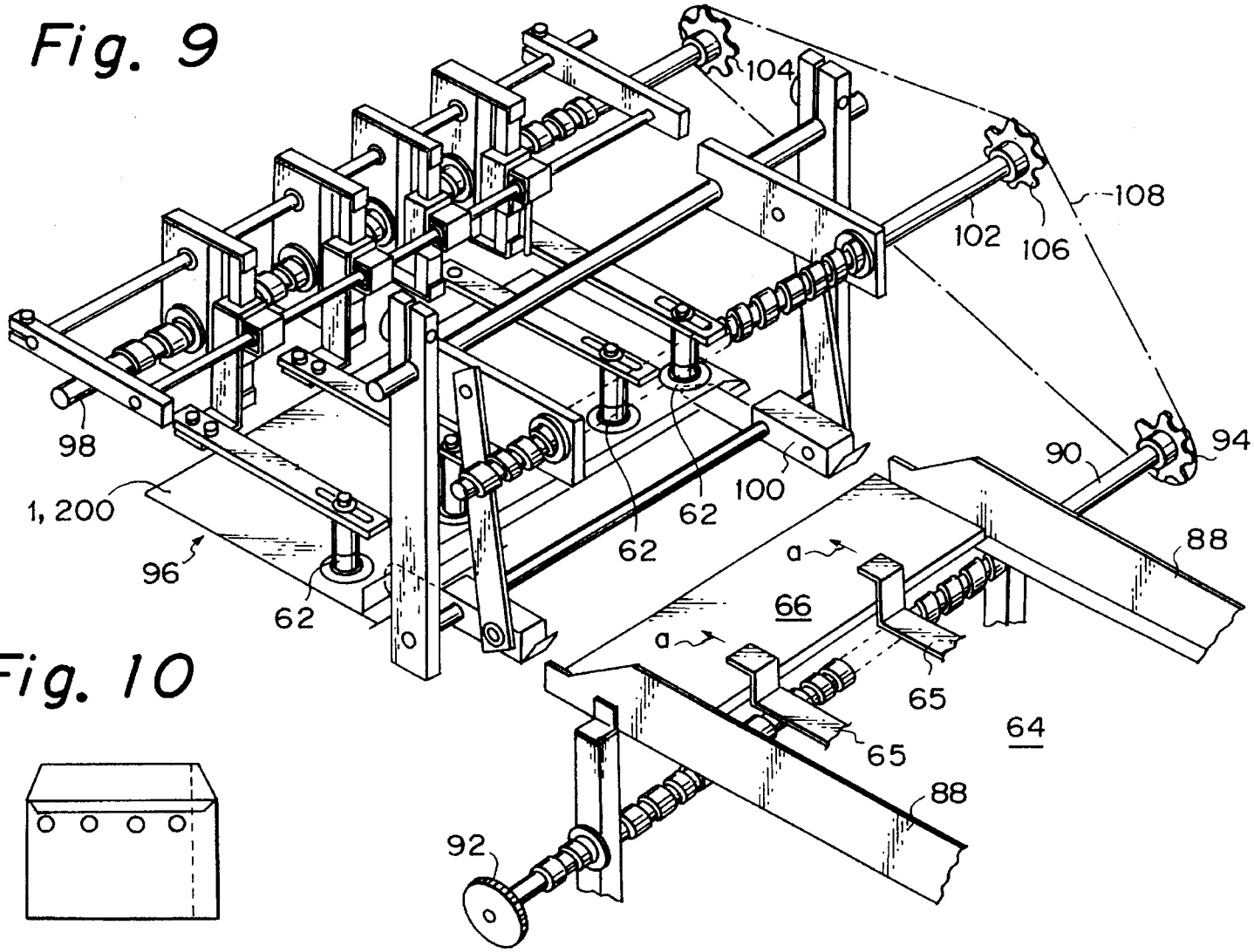
FIG. 9 is a schematic view showing the relationship between an enclosure feeding mechanism and an envelope having cutting perforations and a mounting mechanism of envelope opening means according to the invention.
FIG. 10 is a schematic view showing the envelope opening means of the invention as utilized to an envelope having opening perforations.

Further, in the mail enclosing and sealing device 50 according to the invention, the position of the opening devices 62 such as vacuum pads is displaceable in accordance with the widthwise dimension of the enclosure being enclosed in the envelope. As shown in FIG. 9, enclosures 66 conveyed along route 64 are inserted into envelopes having predetermined configuration including usual envelopes 1 and special envelopes 200 of non-symmetrical configuration such as having cutting perforations 15, by moving the inserting member 65 in arrow a direction (FIG. 9). At first, a pair of enclosure side guides 88 and 88 located on opposite sides of the route 64 are adjusted to make the width slightly wider than the width of the enclosure 66. The adjustment is effected by rotating an adjusting knob 92 mounted on one end of an enclosure side guides width adjusting shaft 90 having left and right hand screw-threads of the same leading amount thereon, with the side guides screw-threadingly engaging with the screw-threads. As shown in FIG. 5, such enclosure side guides width adjusting mechanism appear in the prior arts. A sprocket 94 is mounted on another end of the enclosure side guides width adjusting shaft 90. Further, there is provided, on the downstream side of the enclosure conveying device 64, an envelope opening device 96 generally similar to that shown in FIG. 4 and having an envelope opening device 62. The envelope opening device 96 is provided with sprockets 104 and 106 which are secured respectively on one end of an envelope opening device width adjusting shaft 98 for adjusting the widthwise position of the envelope opening device 62 and on one end of an insert guide width adjusting shaft 102 for adjusting the width of the insert guides 100. A chain 108 encircles the sprockets 94, 104 and 106, and the left and right hand screw-threads provided respectively on the shafts 90, 98 and 102 act to displace the side guides, the envelope opening devices and the insert guides.

Thus, according to the invention, when the size of the enclosure 66 is given, the adjusting knob 92 is rotated to rotate the shaft 90 so as to adjust the width of the enclosure side guides 88 and 88. Then, the sprocket 94 rotates in response to the rotation of the shaft 90. The sprocket 94 drives the chain 108. When the chain 108 is driven, the sprockets 106 and 104 rotate simultaneously. The sprockets 106 and 104 act to rotate the shafts 102 and 98. As the result, the insert guides 100 and the opening device 62 are adjusted rapidly and reliably and simultaneously with the adjustment of the enclosure side guides 88 and 88. Accordingly, as compared with prior art device in which the positional adjustment of the opening device 62, the positional adjustment of the insert guides 100 and the positional adjustment of the enclosure side guides 88 are performed independently and separately, only the positional adjustment of the enclosure side guides 88 is performed according to the invention, which adjustment acts to perform automatically the other two positional adjustments. Thus, the adjustment operation is very easy.

Further, according to the present invention, the position of the vacuum pads 62 is adjusted in response to the size of the envelopes, thus, when the size of the envelopes is large the distance between the opening devices 62 acting on the envelope is increased simultaneously, and when the size of the envelopes is decreased the distance between the opening devices 62 acting on the envelope is also decreased. Thus, according to the invention, the opening portion of the envelope is made to open at the most suitable location, which enables the enclosure inserting operation to be performed reliably.

Figure 6:
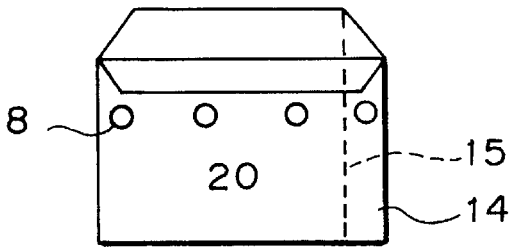
FIG. 6 is a view showing prior art envelope opening means as utilized on an envelope having opening perforations.

The advantage of the present invention is particularly observed when the envelopes utilized are asymmetrical such as the envelopes 200 having cutting perforations 15. In particular, according to prior art devices, one of opening devices 8 is located on the flap portion 14 of the envelope 200 as shown in FIG. 6. However, according to the invention, the center line n—n of the enclosing opening of the envelope 200 is displaced to align with the center line L—L of the inserting and sealing device 50, and the enclosure side guides 88 are adjusted by utilizing the knob 92. Then, the center line of the enclosure 66 is located on the center line L—L of the inserting and sealing device 50 and the center line n—n of the enclosing opening of the envelope 200 is also displaced on the center line L—L of the inserting and sealing device 50, thus, discrepancies such as shown in FIG. 3 are avoided. Further, the opening devices such as vacuum pads 62 are arranged at a suitable position as shown in FIG. 10, the opening of the envelope 200 is opened suitably for receiving the enclosure.

We claim:

1. An enclosing and sealing device for taking out envelopes one by one from an envelope guide (54) of an envelope hopper portion (52) receiving therein envelopes (1, 200), with each envelope having a flap and being supplied to grippers (60) mounted on an intermittently driven envelope conveying chain (58), said envelope (1, 200) being conveyed by movement of the chain (58) with the envelope being retained by the grippers (60), the flap portion of the envelope being opened at a predetermined station (S2), then the envelope (1, 200) being conveyed to a first station (S3) to provide an envelope having an opened portion, the envelope (1, 200) being opened by opening means (62), an enclosure (66) conveyed through another route (64) being enclosed into the envelope, the envelope (1, 200) enclosing the enclosure (66) being conveyed to a second station (S4) and, thereafter, the envelope (1, 200) being ejected in a direction perpendicular to the movement of the chain 58 and the route (64), and the envelope is sealed; in which there are provided in said another route (64) a pair of enclosure side guides (88), and enclosure side guide width adjusting shaft (90) for adjusting the width of the enclosure side guides, and adjusting knob (92) for rotatingly adjusting the shaft (90), a position of the opening means (62) for opening the opening portion of the envelope (1, 200) is adjustable by an envelope opening means width adjusting shaft (98), said shafts (90, 98) are formed to have left and right hand screw-threads of a same leading amount, and sprockets (94, 104) having a same pitch are provide on one end each of the shafts, and sprockets (94, 104) are connected together through a chain (108) whereby rotation of one of the sprockets causes rotation of the other of the sprockets to adjust the machine for varying width envelopes.

2. An enclosing and sealing device according to the claim 1, in which there is provided an insert side guide width adjusting shaft (102) between the envelope opening means width adjusting shaft (98) and the enclosure side guide width adjusting shaft (90), with the insert side guide width adjusting shaft (102) being formed to have left and right hand screw-threads of a leading amount being same to that of the enclosure side guide width adjusting shaft (90) and the envelope opening means width adjusting shaft, and an insert guide width adjusting sprocket (106) is provided on one end of the insert guide width adjusting shaft (102), with a pitch of the insert guide width adjusting sprocket being same as the enclosure side guide width adjusting sprocket (94), and the envelope opening means width adjusting sprocket (104) and the enclosure side guide width adjusting sprocket (94) the envelope opening means width adjusting sprocket (104) and the insert guide width adjusting sprocket (106) are connected together through said chain (108).

3. A mail enclosing and sealing device for taking out envelopes one by one from an envelope guide (54) of an envelope hopper portion (52) receiving therein envelopes (1, 200), with each envelope being supplied to grippers (60) mounted on an intermittently driven envelope conveying chain (58), said envelope (1, 200) having a flap and being conveyed by movement of the chain (58) with the envelope being opened at a predetermined station (S2) to provide an envelope having an open portion, then the envelope (1, 200) being conveyed to a first station (S3), the opening portion of the envelope (1, 200) being opened by opening means (62), an enclosure (66) conveyed through another route (64) being enclosed into the envelope, the envelope (1, 200) enclosing the enclosure (66) being conveyed to a second station (S4) and thereafter, the envelope (1, 200) being ejected in a direction perpendicular to the movement of the chain (58) and the route (64), and the envelope is sealed; in which there are provided in said another route (64) a pair of enclosure side guides (88), and enclosure side guide width adjusting shaft (90) for adjusting the width of the enclosure side guides, and an adjusting knob (92) for rotatingly adjusting the shaft (90), a position of the opening means (62) for opening the opening portion of the envelope (1, 200) is adjustable by an envelope opening means width adjusting shaft (98), said shafts (90, 98) are formed to have left and right hand screw-threads of a same leading amount, and sprockets (94, 104) having a same pitch are provided on one end each of the shafts, the sprockets (94, 104) are connected together through a single chain (108) so that rotation of one of the sprockets causes rotation of the other of the sprockets, and a position of the envelope hopper portion (52) is movable and adjustable in a direction perpendicular to the center line (L—L) of an inserting and sealing device (50).

4. An envelope processing unit for taking out envelopes one by one from an envelope hopper portion receiving therein envelopes, each of said envelopes having a flap portion and perforations in one widthwise end thereof and along said one end for conveying each envelope to an enclosing station with the flap portion of the envelope being at an open condition, and for enclosing an enclosure into the envelope with an opening portion of the envelope being opened in up and down directions beforehand by displacing the enclosure along a moving direction of the envelope, said unit comprises:

offset means for displacing and adjusting a location of said envelope hopper portion in a widthwise direction of the envelope by an amount corresponding to a location of the perforations in the envelope, said offset means having envelope guide means (54) including a pair of envelope guides (54) from which guide means an envelope (200) is taken, a pair of blocks (68), each block (68) being mounted on a respectively associated guide (54), a screw shaft (70) having a screw shaft axis and left and right hand screw threads of a same leading amount, each block (68) being threadably mounted on a respectively associated one of the screw threads for adjustably moving the guides (54) opposite directions relative to each other to position the guides (54)

an offset base (76) supporting the screw shaft (70), and slider means mounted on a fixed frame (82) for adjusting slidably the position of the offset base (76) in a direction parallel to the axis of the screw shaft (70), displacing means (58) for displacing the envelope taken out of the envelope hopper portion and being in an offset condition, opening means (62) for opening an opening portion of the envelope in up and down directions at the enclosing position, and having a plurality of opening members which are displaceable in the widthwise direction of the envelope with the center line thereof being on a center line of said unit, and a pair of enclosure side guides (88) disposed on a moving passage of the enclosure being supplied by supplying means, and being displaceable in the direction of the width of the envelope and with the center line thereof being on the center line of said unit.

5. An envelope processing unit according to claim 4, in which said slider means comprises:

a slider (78) provided on the offset base (76), rail means (80) mounted on the fixed frame (82), on which rail means said slider (78) is slidably mounted, a screw shaft (84) on which said offset base (76) is mounted, and a knob (86) mounted on the screw shaft (84) for adjusting the position of said guide means (54).

6. An envelope processing unit for taking out envelopes one by one from an envelope hopper portion receiving therein envelopes each envelope having a flap portion, for conveying each envelope to an enclosing station with the flap portion of the envelope being in an open condition, and for enclosing an enclosure into the envelope with the open envelope being opened in up and down directions beforehand by displacing the enclosure along a moving direction of the envelope, and in which the location of said envelope hopper portion is adjustable, the improvement comprising, means for displacing the envelope hopper portion in a widthwise direction of the envelope to adjust the location of the hopper on the processing unit including an offset base (76) supporting the envelope hopper portion, a rail (80) extending in the widthwise direction of the envelope and secured to said unit, a slider (78) secured to me offset base, engaging said rail and being displaceable on the rail, and actuating means (84, 86) acting on the slider (78) to move the slider (78) along the rail.

7. An envelope processing unit according to claim 6 wherein the location of said envelope hopper is adjustable in a direction perpendicular to the centerline (L—L) of the unit.

* * * * *